US005597326A

United States Patent [19]

DeLessert et al.

[11] Patent Number: 5,597,326

[45] Date of Patent: Jan. 28, 1997

[54] LAMINATED MINIATURE MULTI-CONDUCTOR CONNECTOR AND METHOD FOR MANUFACTURE

[75] Inventors: Daniel DeLessert, Newberg; Michael L. Demeter, Vernonia, both of Oreg.

[73] Assignee: The Whitaker Corporation, Wilmington, Del.

[21] Appl. No.: 607,049

[22] Filed: Feb. 26, 1996

Related U.S. Application Data

[63] Continuation of Ser. No. 330,983, Oct. 28, 1994, abandoned.

[51] Int. Cl.[6] ..... H01R 9/09

[52] U.S. Cl. ..... 439/608; 439/886; 439/933

[58] Field of Search ..... 439/86, 608, 931, 439/933, 108, 88, 90, 886

[56] References Cited

U.S. PATENT DOCUMENTS 4,577,922 3/1986 Stipanuk et al. ..... 439/933
4,921,430 5/1990 Matsuoka ..... 439/931
5,169,321 12/1992 Matsuoka ..... 439/886
5,295,840 3/1994 Matsuoka ..... 439/886

*Primary Examiner*—Gary F. Paumen

[57] ABSTRACT

An electrical connector for connection to multiple cables comprises, multiple conductor elements (36), and multiple insulating separator elements (38) separating the conductor elements (36) from each other, body portions (40) of the conductor elements (36) and the separator elements (38) are fabricated from sheets of material laminated together, an array of spaced apart spring contact portions (22) project from the body portions (40), and an array of spaced apart termination portions (56) project from the body portions (40) for connection to respective conductors of multiple cables, and a transverse shield (48) extending across edges on the conductor elements (36) and edges on the separator elements (38).

18 Claims, 7 Drawing Sheets

LAMINATED MINIATURE MULTI-CONDUCTOR CONNECTOR AND METHOD FOR MANUFACTURE

This application is a Continuation of application Ser. No. 08/330,983 filed Oct. 28, 1994, now abandoned.

BACKGROUND OF THE INVENTION

The present invention relates to miniature electrical connectors for connecting very small multi-conductor cables to closely spaced terminal pads on printed circuits or the like.

In many situations where electrical signals are being carried among separate subassemblies of complex electrical and electronic devices reduced size contributes greatly to the usefulness or convenience of the devices or of certain portions of them. To that end, cables including extremely small conductors are now available, and it is practical to manufacture very closely spaced terminal pads accurately located on circuit boards or the like. It is therefore desirable to have a connector of reduced size, to interconnect such cables and circuit boards repeatedly, easily, and reliably, and with a minimum adverse effect on electrical signal transmission in a circuit including such a connector. As electrical signals with higher frequencies are employed it becomes more important to maintain shielding and provide a waveguide or transmission line configuration as near as possible to the connection of a cable to a circuit board or the like.

For some electronic circuit equipment it is necessary to be able to replace and reconnect cables carrying large numbers of independent high frequency signals on extremely small conductors. It is important to be able to effect reliable interconnection of each cable conductor to a respective circuit terminal with a minimum effect on overall circuit impedance, and within a minimum amount of space.

In many applications where cables are connected and disconnected from circuit boards it is desired to have a wiping contact, so that insertion of a connector reliably establishes good electrical contact between the connector and the circuit board terminal pad surfaces.

It is well known to mold supportive bodies of dielectric plastic around contact arrays for multi-conductor connectors. It is still desired, however, to produce connectors with contact spacings smaller than can be made in that way.

Robin et al. U.S. Pat. No. 4,571,014 discloses a modular connector for use in high frequency circuits, in which planar shields are stacked between circuit boards each having a row of female connector sockets, to produce a multi-conductor connector having several aligned rows of sockets arranged in a grid. The construction disclosed, however, results in a connector of a considerably larger size than is desired for interconnecting very small multi-conductor cables with circuits.

Okamoto et al. U.S. Pat. No. 5,145,413 discloses a connector in which several lead terminals are held side-by-side and are molded within an insulating resin to form a linear array, with a plurality of such arrays being contained in a connector housing.

Yatsu et al. U.S. Patent No. 5,195,899 discloses matable plug and jack connectors. In the plug connector disclosed, several conductors are held in small holes defining each of a pair of arrays of such conductors each having a male signal terminal in the form of an exposed contact point, and a planar male ground connector is located between the two arrays of male signal terminals.

Dudek et al. U.S. Pat. No. 5,122,065 discloses a connector in which walls having conductive surface layers surround signal conductors to form grounded tunnel-like passages through which the signal conductors extend, and wiping contact surfaces are provided at a front edge of the connector.

Pierini et al. U.S. Pat. No. 3,689,865 discloses a multi-conductor electrical connector for connection to terminal pads on both sides of a circuit board through wiping contacts in the form of flat springs, but the contacts are attached separately to a supporting spacer, which requires that the contacts be spaced apart from one another a distance greater than is desired for connecting very small multi-conductor cables.

What is still needed, then, is a multi-conductor connector, and a method of making such a connector, which is capable of providing reliable wiping contact with spring pressure, with closer spacing than has previously been possible, and which can be used in high frequency applications with minimal adverse effects on signal transmission.

SUMMARY OF THE INVENTION

The present invention overcomes some of the previously mentioned shortcomings and disadvantages of previously known multi-conductor electrical connectors by providing an improved connector and a method for manufacturing such a connector.

In accordance with the present invention a connector includes at least one laminated array of generally planar electrically conductive elements, at least some of which are signal conductor elements, arranged alternately with insulating separator elements. All of the conductor elements and separator elements are held together by adhesives, with a contact portion of each signal conductor element extending from one end of the connector.

In one embodiment of the connector each insulating separator element includes a shield conductor sandwiched between a pair of parallel layers of dielectric material.

In one embodiment of the connector, a transverse shield, which may also include a shield conductor layer sandwiched between a pair of layers of dielectric material, extends along each of the top and the bottom of the laminated array of conductors and separators.

Preferably, each contact portion is resiliently flexible in the plane of the conductor element of which is it a part, to provide mechanical pressure of the contact portion against a terminal pad to which it is connected.

A miniature multi-conductor connector is made according to the method of the invention by preparing planar conductor and separator elements, as by cutting them individually to shape mechanically or by laser or chemical etching action, from sheets or strips of the appropriate materials.

According to the method of the invention an appropriate amount of an adhesive material is applied to the conductor and separator elements, and the elements are aligned and pressed together for the time required for the adhesive material to fasten together the laminated array of conductors, separated from one another by the alternate separator elements.

According to one variation of the method of the invention each conductor including a contact portion is provided with an alignment eye, and an adjustable fixture is used to support a rod placed through the alignment eyes of a group of such conductors being assembled into a connector, while a body portion of each such conductor rests on another part of the fixture so that the contact portions of all of those conductors are aligned in a single plane in the laminated array.

By preparation of the conductor elements and separator elements of shects of appropriately thin material, reliably accurate center-to-center contact spacing of as little as 0.006 inch may be obtained.

In a preferred embodiment of the invention, a connector including a pair of arrays of contacts facing toward each other is prepared by attaching an array of laminated conductor and separator elements to each side of a transverse shield, with the contact elements facing toward each other and aligned with each other to provide for connection to an edge of a circuit board having terminal contact pads arrayed on each of its opposite faces. In such a connector the thickness of the transverse shield is chosen to establish a required spacing between the contact surfaces of the pair of contact arrays.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
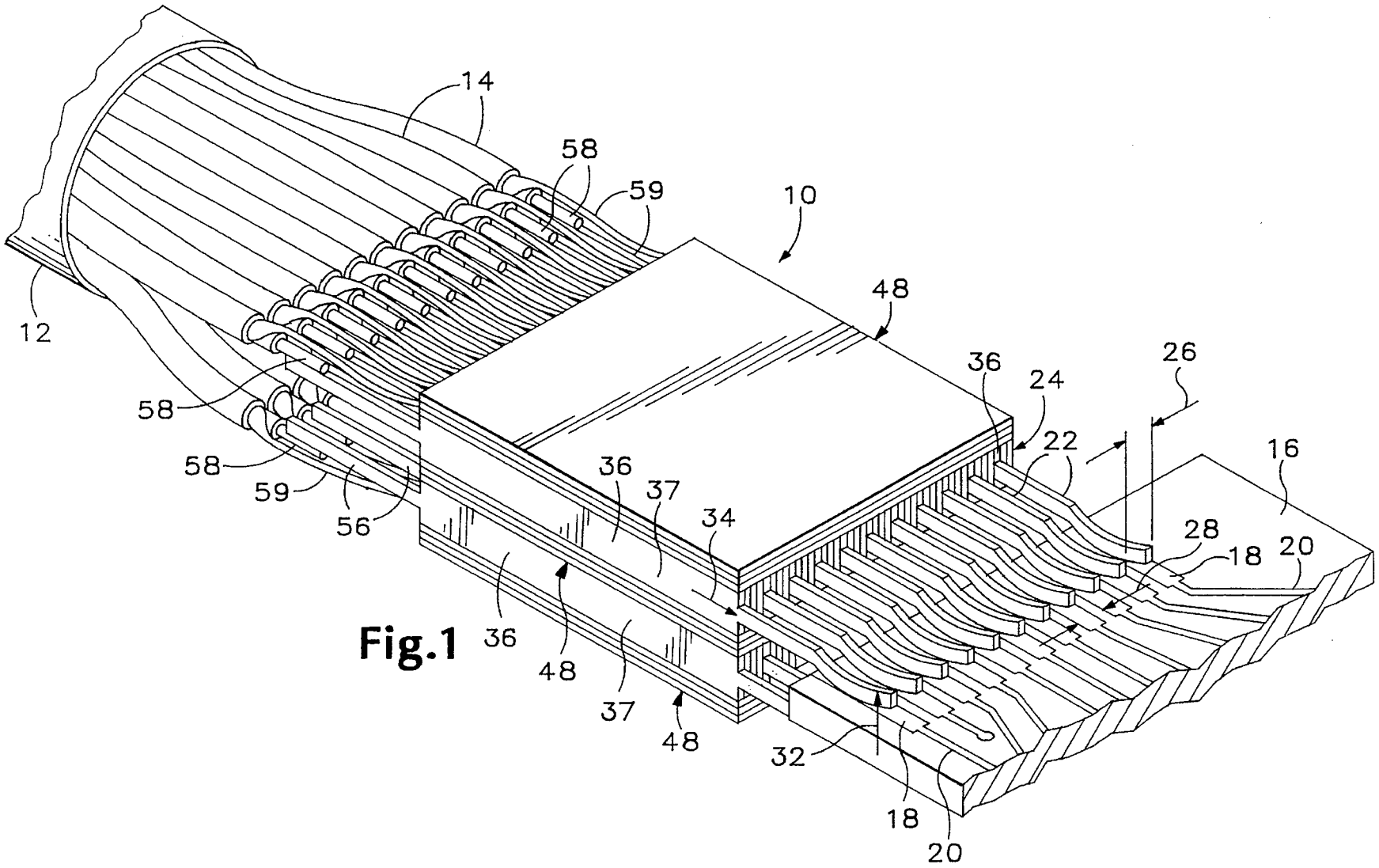
FIG. 1 is a perspective view of a miniature multi-conductor electrical connector according to the present invention, together with a portion of a multi-conductor cable and a portion of a circuit board with which the cable is to be interconnected using the connector.

Referring now to FIG. 1 of the drawings which form a part of the disclosure of the invention herein, a connector 10 according to the present invention is shown interconnected with a terminal portion of an electrical cable 12 containing a plurality of coaxial conductor pairs 14. The connector 10 is shown connecting the cable 12 with an array of contact pads 18 of an edge portion of a circuit board 16 with respective conductor traces 20 leading away from the contact pads 18. A similar array of contact pads and conductor traces (not shown) is located on the underside of the circuit board 16, aligned opposite the contact pads 18.

Figure 2:
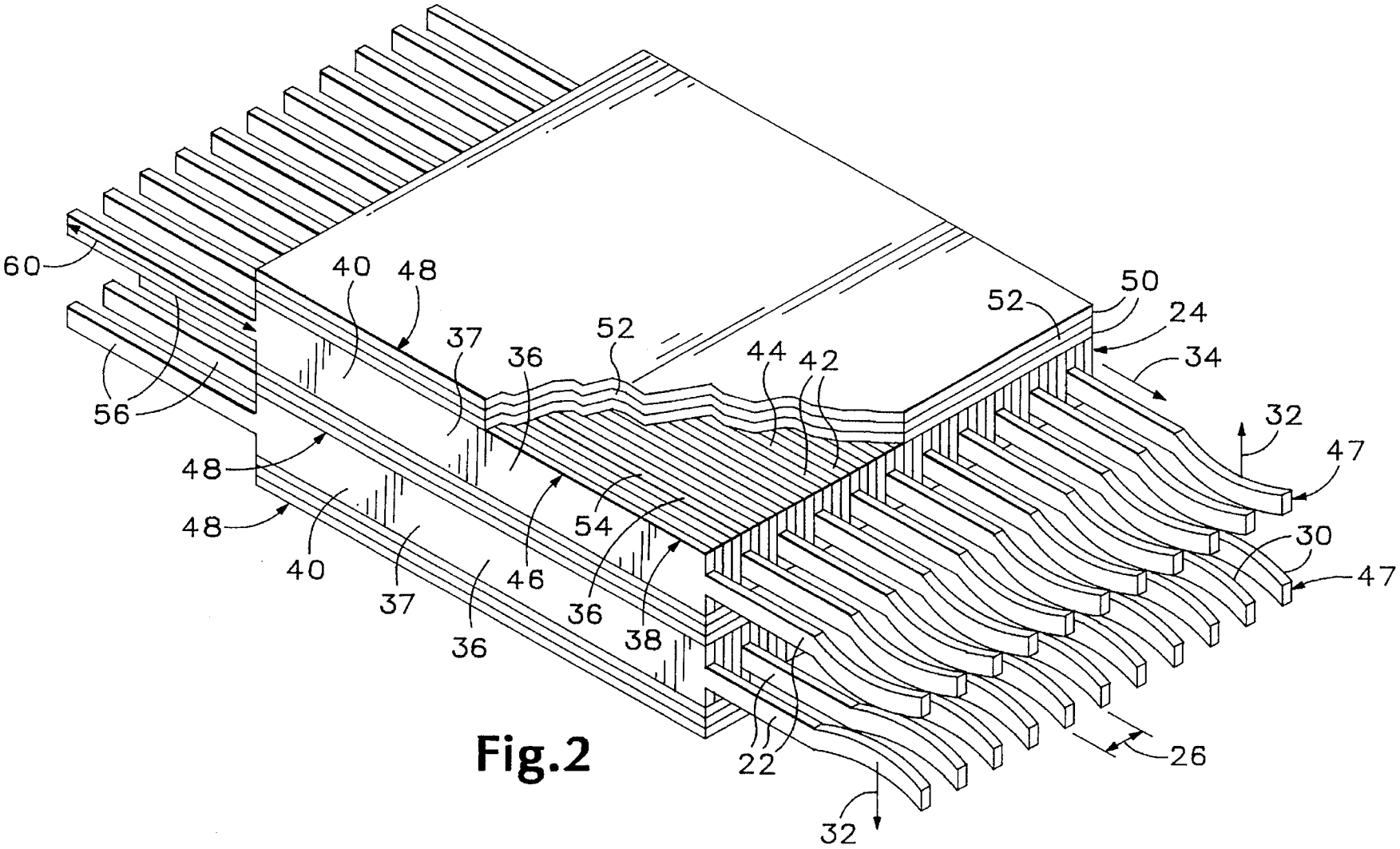
FIG. 2 is a partially cut-away perspective view of the connector shown in FIG. 1.
Figure 3:
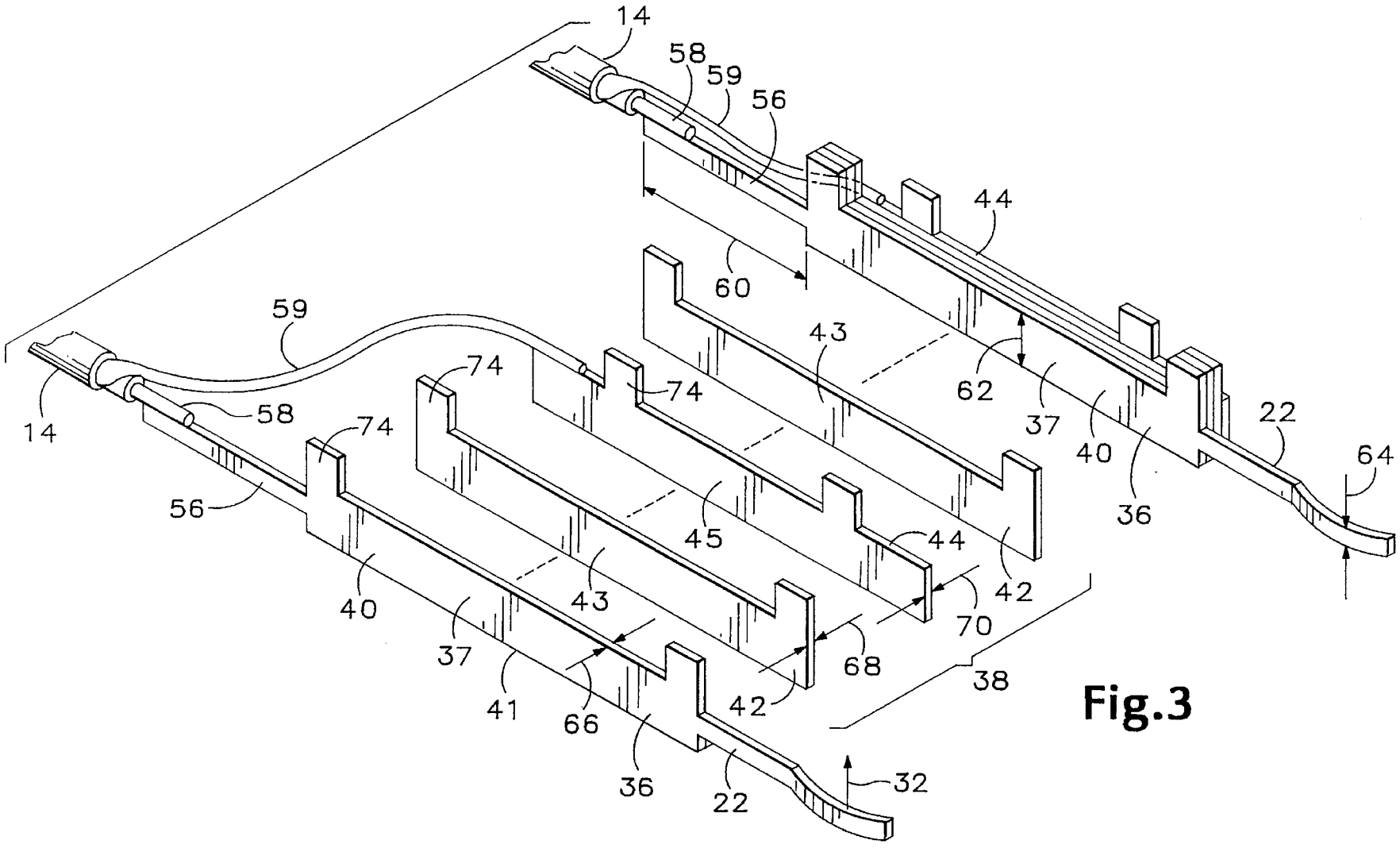
FIG. 3 is a perspective detail view showing the connection of a multi-conductor cable with the termination end of the connector shown in FIG. 1.

Referring now also to FIGS. 2 and 3, several contact portions 22 extend parallel with each other from a first, or contact, end 24 of the connector 10, spaced at a contact pitch 26 equal to the spacing 28 between contact pads 18 on the circuit board 16. Each contact portion 22 includes a convex contact surface 30 exposed beyond a plane defined transversely by the bottom, or inner, margins 41 of the body portions 40 of the signal conductor elements 36 and is resiliently flexible. When the connector 10 is in place interconnecting the cable 12 with the circuit board 16, a slight displacement in the direction of the arrow 32 occurs when the connector 10 is inserted into a connector mounting position with respect to the circuit board 16 in the direction indicated by the arrow 34. As a result each contact surface 30 is held in electrical contact with the surface of a respective one of the contact pads 18 by spring pressure exerted by the contact portion 22.

Referring particularly to FIG. 3, the connector 10 includes a desired number of signal conductor elements 36 which are generally planar and are preferably fashioned of thin sheet metal having planar faces 37. The signal conductor elements 36 are aligned with one another, separated from each other by insulating separator elements 38, which are also generally planar, are generally rectangular in shape, and may be slightly larger in size than a body portion 40 of each of the signal conductor elements 36. Each insulating separator 38 preferably is a sandwich-like assembly of a pair of thin planar dividers 42 of dielectric material having opposite planar faces 43 and a shield conductor 44 having planar faces 45 located between the dividers 42. Preferably the shield conductor 44 is of a size and shape similar to that of each of the two divider dielectric layers 42.

All of the body portions 40 of the signal conductor elements 36 and the insulating separators 38 are held together tightly, aligned with and with their major planes parallel with each other and interconnected by respective layers (not shown) of a suitable electrically non-conductive adhesive material forming a laminated body 47. For example, an epoxy resin adhesive such as Scotch-Weld 2290 Epoxy Adhesive/Coating, manufactured by the 3M Company of Minneapolis, Minn. and known in connection with adhesive lamination of armatures for miniature electric motors, is suitable. This adhesive is low in viscosity (40–80 centipoise), can be diluted and applied in a film having a thickness, when dried, of less than 0.013 mm (0.0005 in), and has good dielectric properties. Thus, a planar face 37 on each side of the body portion 40 of each signal conductor 36 is adhesively attached to a respective planar face 43 of an insulating divider 42, and similar planar faces 45 of the shield conductors 44 are attached by adhesive material to the opposite parallel faces 43 of the dividers 42, forming a laminated body 46, including an array 47 of contact portions 22.

Preferably, at least a pair of laminated bodies 46 of signal conductor elements 36 and insulating separators 38 are adhesively fastened to each other but separated from each other by a transverse shield 48 extending along the opposed bottom sides 49 of the laminated bodies 46. Such a transverse shield 48 is also provided on the top side 54 of each laminated body 46 of the connector 10.

The transverse shields 48 each include a pair of shield dielectric layers 50 of planar dielectric sheet material attached respectively to the opposite sides of a conductive shield layer 52 of planar conductive material. Preferably, both the shield conductors 44 and the conductive shield layers 52 are of a magnetically highly permeable and electrically conductive metal such as an annealed nickel alloy or copper alloy. The dielectric material for the dividers 42 and the shield dielectric layers 50 may be chosen on the basis of dielectric strength, mechanical strength and the temperature where used. A suitable dielectric material for those elements is a polyimide such as the material well known by its trade name Kapton™.

Each of the signal conductor elements 36 includes a termination portion 56 located at the opposite end of the body portion 40 from the contact portion 22, providing room for electrical connection thereto of a desired conductor, such as a central conductor 58 of one of the coaxial conductor pairs 14 of the cable 12. Each of the termination portions 56 can be manufactured in a desired length 60 to accommodate the method of connection to be used, such as soldered or welded connections of the central conductor 58. The coaxial shield conductor 59 may also be soldered or otherwise connected electrically to a respective shield conductor 44 or transverse conductive shield layer 52.

Figure 4A:
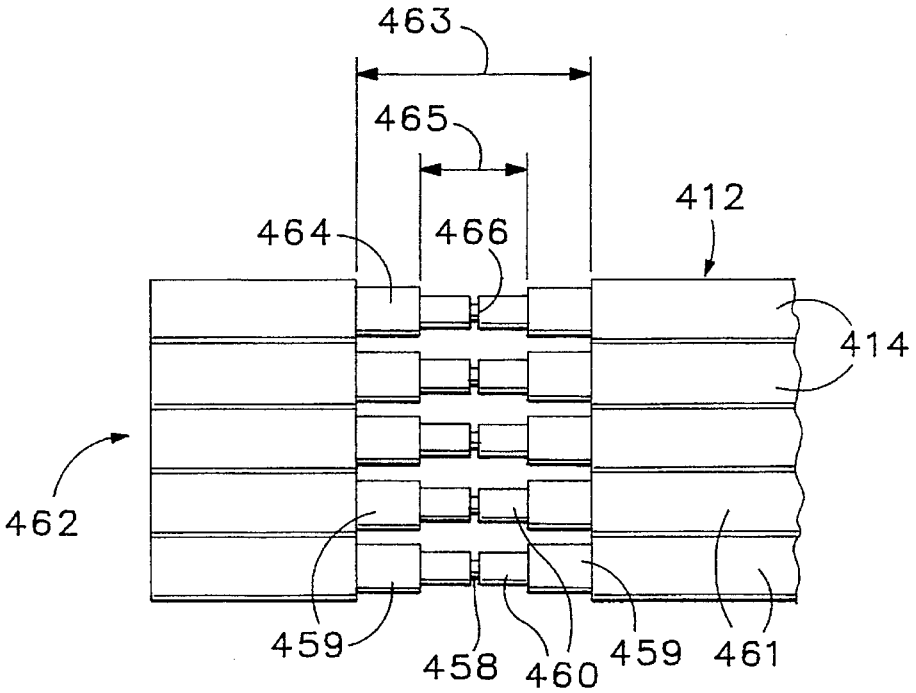
FIG. 4*a* shows a flat cable at a first stage of preparation for connecting its conductors to the connector.
Figure 4B:
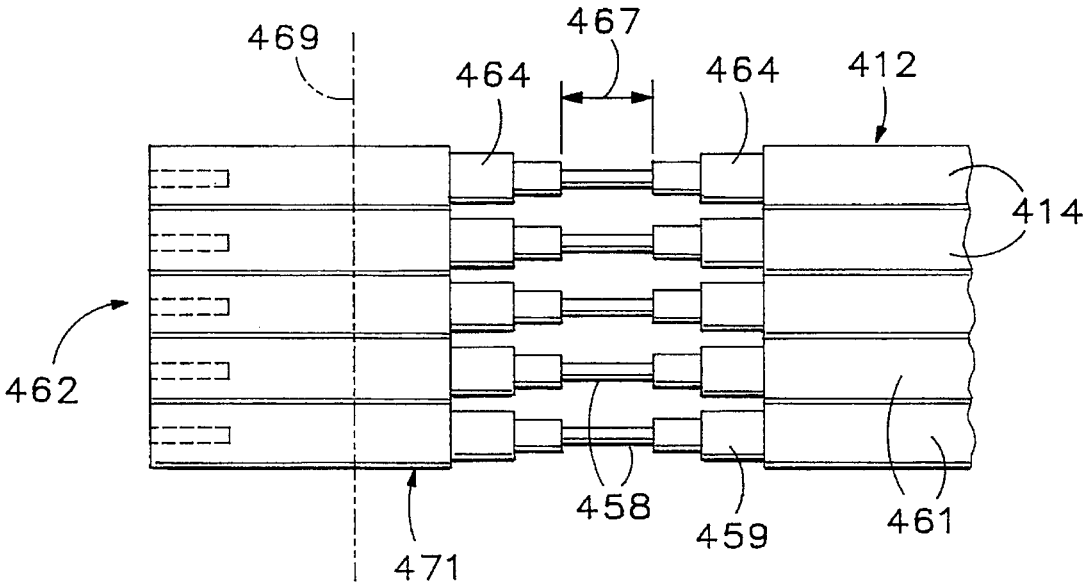
FIG. 4*b* shows successive steps of preparing the flat cable for connecting conductors to the connector.

Referring to FIGS. 4*a* and 4*b*, a flat cable 412 includes several coaxial conductor pairs 414 each including a shield conductor 459 and a central conductor 458 separated from each other by a concentric dielectric layer 460. A jacket 461 of dielectric material surrounds the shield 459 of each coaxial conductor pair, and the several jackets 461 are located closely alongside one another and interconnected with each other by a coating of an adhesive material, to hold the coaxial conductor pairs 414 in ribbonized configuration at the desired pitch, preferably corresponding to the pitch between termination portions 56 of a connector 10. A mixture of methyl ethyl ketone and a polyvinylchloride has been found to be a suitable adhesive for ribbonizing the conductor pairs 414 as a flat cable.

As shown in FIG. 4*a*, an end portion 462 of a cable 412 is prepared for mass termination to effect connection of the signal conductors 458 with respective termination portions 56 of a connector 10, by stripping away the material of the jacket 461 by a laser over a distance 463. Preferably, a frequency quadrupled YAG laser is used to provide intense radiation in the ultra-violet wavelength to ablate the adhesive coating and the jacket material over a desired length 463 of the cable 412 near the end 462 to be terminated to the connector 10. For example, the length 463 may be about 2.5 mm (0.1 inch). The shields 459 are then tinned, as by reflowing a solder preform by heating with a thermode, to coat the wires of a braided or served shield without damaging the material of the dielectric layer 460.

Thereafter, a similar laser is used to cut away the exposed portions of the tinned shield 459 on the two faces of the flat cable 412, over a central area having a shorter length 465, leaving respective portions 464 of the tinned shield 459 exposed between the ends of the ribbonized jacket material, as shown in FIG. 4*a*. In order to complete removal of the shield material in the central area, the cable 412 is bent back and forth as necessary to break any remaining connected portions of the tinned material of the shields 459, which can then be picked free from the dielectric material 460 of the coaxial conductor pairs. Bending back and forth also work-hardens the remaining exposed portions 464 of shields 459. Thereafter, a laser is used again to make a narrow cut through the dielectric material 460 surrounding each of the central conductors 458, to expose them as shown in FIG. 4*a*. The best laser to be used for this step will depend upon the material used as the dielectric. For example, a dielectric layer 460 of PTFE, unless it is pigmented, may require the use of a $CO_2$ laser, while other dielectric materials may be cut more easily using the frequency quadrupled YAG laser mentioned previously.

As shown in FIG. 4*b*, once the dielectric material 460 has been cut to expose the central conductors 458, the entire set of ribbonized jackets 461, tinned shields 459 and dielectric material 460 of the portion of the cable nearest the end 462 is slid a small distance apart from the corresponding portions on the main part of the flat cable 412, to expose a portion of the central conductors 458 having a length 467. Thereafter, the flat cable 412 may be cut shorter at the end 462, as along line 469 of FIG. 4*b*, leaving a short tag end 471 including a portion of the ribbonized material of the jackets 461 left intact to maintain the spacing between the central conductor portions 458 which have thus been exposed.

Figure 5:
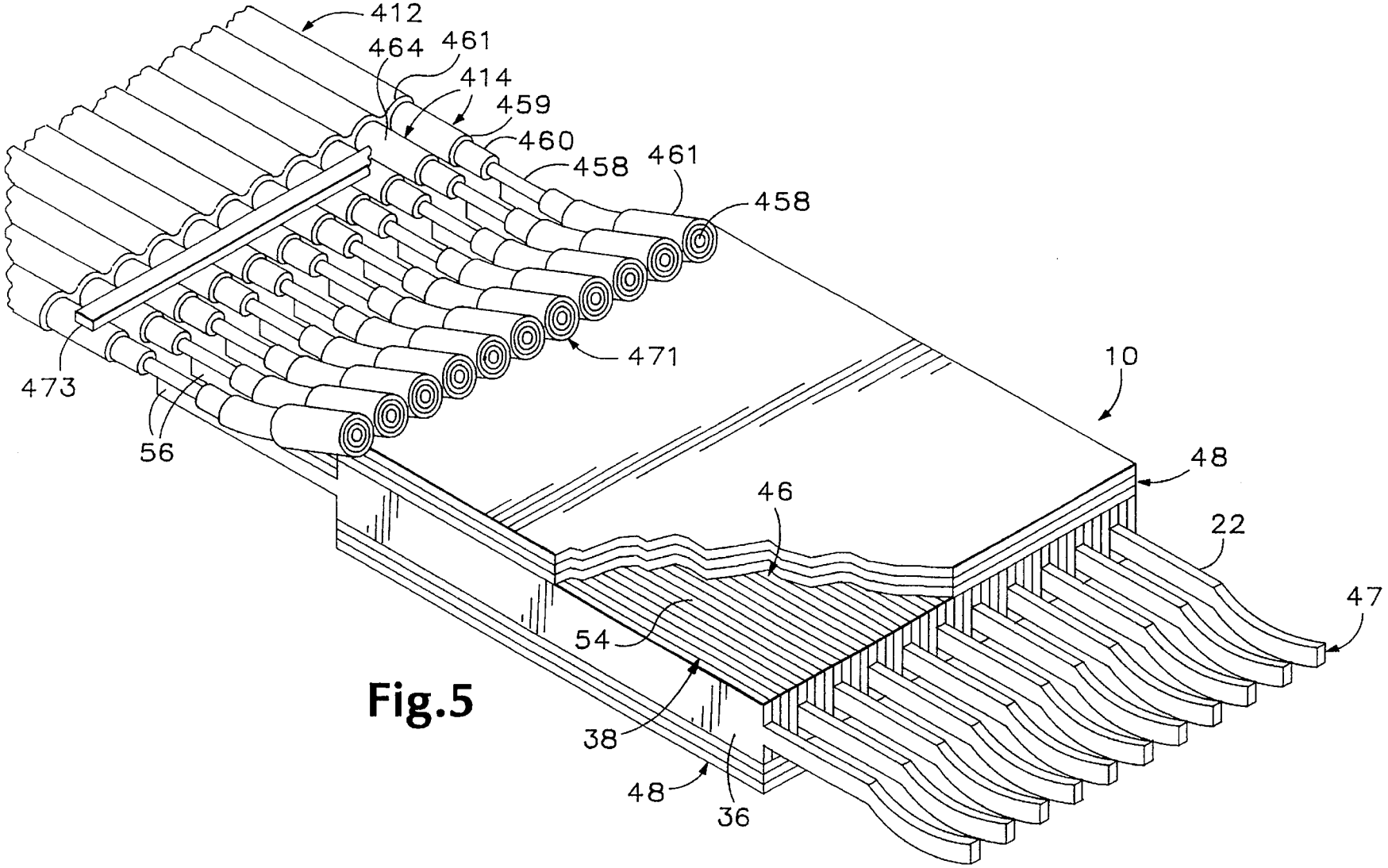
FIG. 5 is a perspective view showing the conductors of a flat cable, prepared as shown in FIGS. 4*a* and 4*b*, connected to the connector.

Once the cable 412 has been prepared in this manner, the central conductors 458 may be simultaneously connected to the termination portions 56 of a connector 10, as shown in FIG. 5, with the tag end 471 of the cable 412 holding the central conductors 458 at the desired pitch during termination. If desired, a bus bar 473 may similarly be connected separately to the tinned shields 459, to connect the shields in common to an appropriate one of the transverse shields 48.

Figure 6:
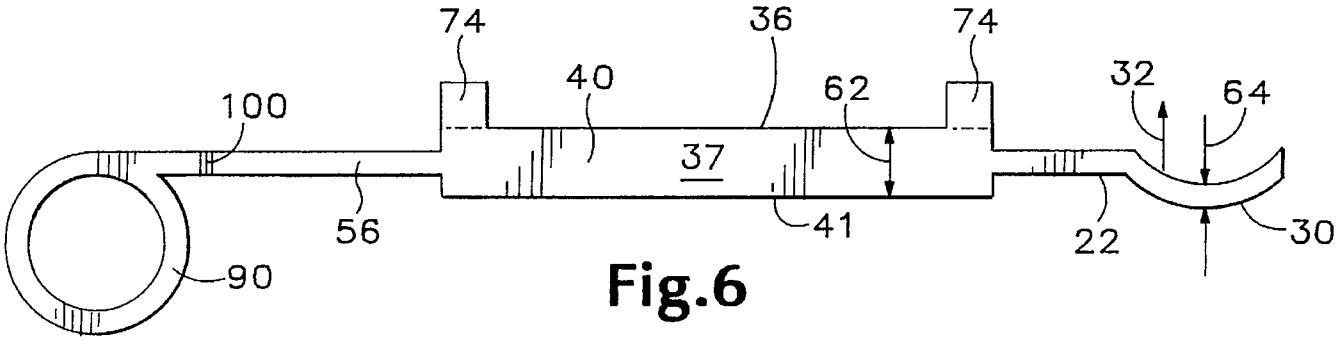
FIG. 6 is a side elevational view of one of the signal conductor elements of the connector shown in FIG. 1, at an enlarged scale.

The body portion 40 of each signal conductor element has a body depth 62, shown best in FIG. 6, giving each of the signal conductors 36 and insulating separators 38 a sufficient beam strength and the signal conductors 36 a sufficient cross-sectional area of conductive material. To some extent, the body depth 62 may be designed to accommodate the signals to be conducted through the connector 10 so that a desired electrical impedance is seen through the connector 10. The contact portion 22, however, is smaller in the direction of the body depth, having a depth 64 of about 0.1 mm (0.004 inches), for example, so that the contact portion 22 can flex resiliently as a spring, in response to insertion of the connector 10 into contact with the contact pads 18 of the circuit board 16.

In order to accommodate different spacing of terminals such as contact pads 18 of a circuit board 16 or the like to which the connector 10 is to be connected, the thickness 66 of each signal conductor element 36, the thickness 68 of each dielectric divider 42, and the thickness 70 of each shield conductor 44 may be chosen to provide the appropriate contact pitch 26, taking into account, as well, the thickness of each layer of adhesive material between the signal conductor elements 36, dividers 42, and shield conductors 44. For example, the signal conductor 36 may have a thickness 66 of 0.20 mm (0.008 inch), and the thicknesses 68 and 70, respectively, of the dividers 42 and shield conductor 44 may be 0.125 mm (0.005 inch) with each layer of adhesive 0.012 mm (0.0005 inch) thick, for a contact pitch 26 of 0.625 mm (0.025 inch). Smaller thicknesses 66, 68 and 70 may also be used for a smaller contact pitch 26.

Figure 7:
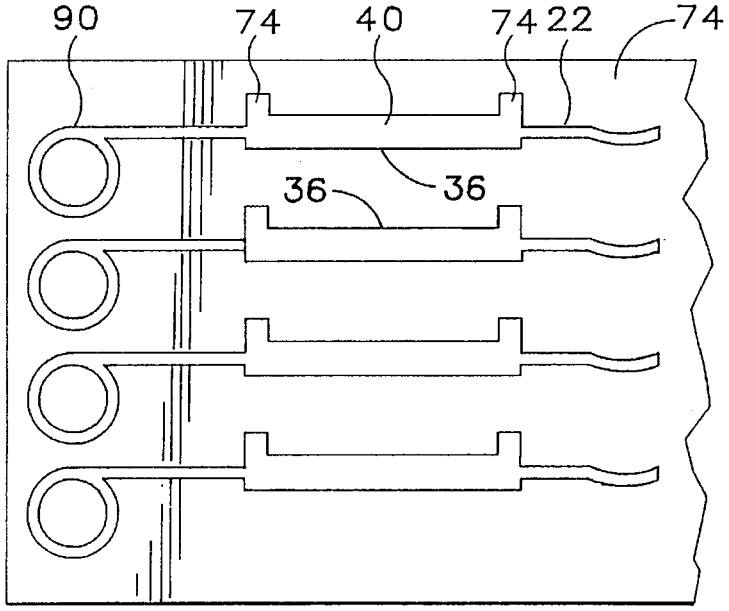
FIG. 7 is a side view of several signal conductors similar to the one shown in FIG. 6, shown attached to a portion of a sheet of metal, during an intermediate stage of manufacture of the signal conductor.

Referring to FIG. 7, the signal conductor elements 36 and the shield conductors 44 may be manufactured by cutting them from sheets of the appropriate metal of the appropriate thickness. This can be accomplished by chemical etching, using well known circuit board manufacturing techniques. Because of the small size of each conductor element it is convenient to leave the pieces attached to the surrounding sheet 72 by respective tie tabs 74 which are etched part of the way through the sheet of metal so that the pieces can easily be removed after completion of the etching process, leaving the tie tabs 74 available to help handle the conductive elements.

Figure 9:
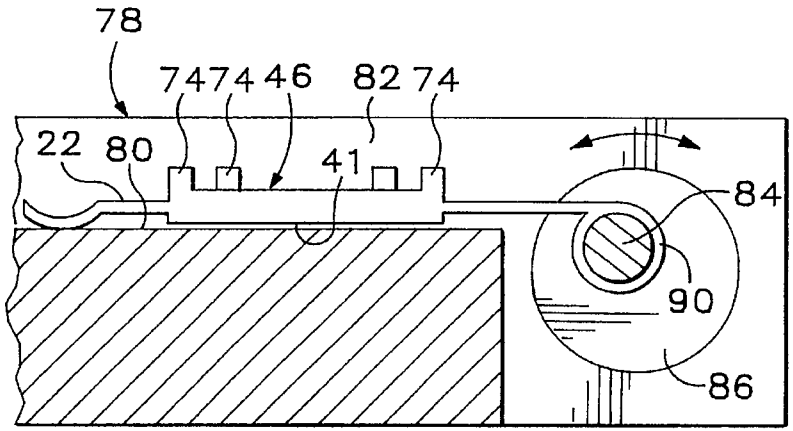
FIG. 9 is a sectional side view of the clamp shown in FIG. 8, taken along line 9—9, showing the manner of aligning signal conductors and dividers as part of the method of the present invention for manufacturing a multi-conductor miniature connector such as the one shown in FIG. 1.
Figure 8:
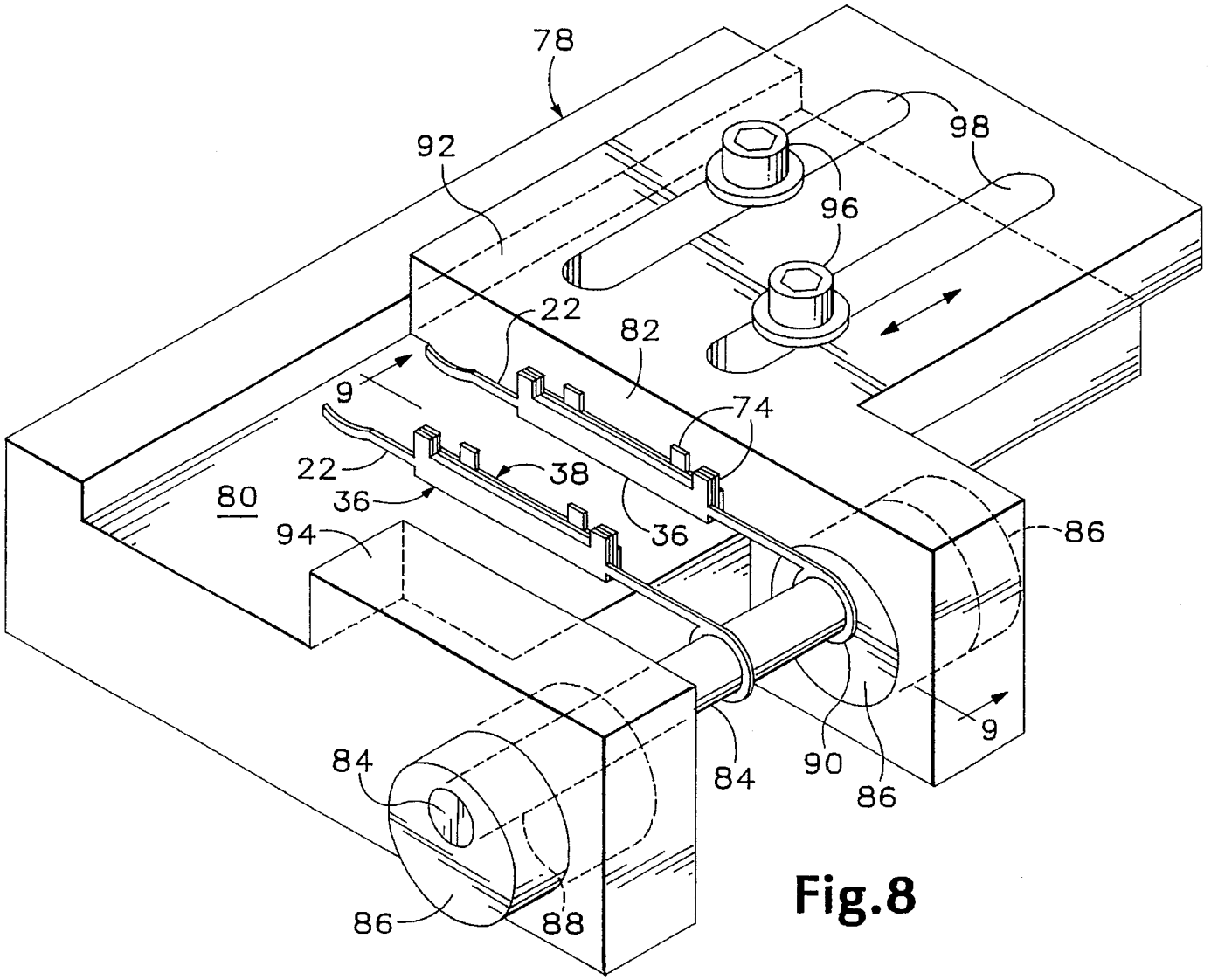
FIG. 8 is a perspective view of a portion of an alignment fixture and one of the signal conductors of a connector such as that shown in FIG. 1, showing how certain parts of the connector are held together in proper alignment during one stage of the assembly of a connector such a that shown in FIG. 1.

Because it is necessary for each of the contact surfaces 30 in an array 47 to exert pressure against a respective contact pad 18 or the like, it is important that they be aligned with one another properly during manufacture of the connector 10. To simplify the process of manufacture, each of the insulating separators 38 may be attached individually by adhesive material to a respective one of the signal conductor elements 36 so that it is necessary in assembling the connector 10 to align only the signal conductor elements 36 precisely with one another. Since each signal conductor element 36 is substantially identical with each other this alignment can be carried out using an alignment clamp 78 which has a flat alignment surface 80, as shown in FIGS. 8 and 9. A pair of parallel clamping faces 82 are perpendicular to the alignment surface 80 and an alignment dowel 84 extends between a pair of coaxially aligned rotatable adjustment devices 86, each of which defines a correspondingly located eccentric bore 88 through which the alignment dowel 84 extends removably. An alignment eye 90 is provided on each of the signal conductor elements 36, as shown in FIG. 7, and the appropriate number of signal conductor elements 36, preferably assembled with a respective insulating separator element 38 attached to each signal conductor element, are placed on the alignment surface 80 side-by-side, with the alignment dowel 84 extending through the alignment eye 90 of each signal conductor element 36. The rotatable adjustment devices 86 are rotated as necessary to have all of the contact surfaces 30 of the signal conductor elements 36 rest solidly on the alignment surface 80, and with the adhesive material properly applied as required to each of the exposed planar faces 37 and 43 the clamping faces 82 are moved together to provide the required amount of pressure to fasten the signal conductor elements and dividers 42 together, by moving the movable jaw 92 of the clamp along the alignment surface 80 toward the fixed jaw 94. It will be understood that for large scale production, a clamp having the essential features of the clamp 78 may be manufactured for more automatic operation.

Depending upon the type of adhesive used, the movable jaw 92 and fixed jaw 94 may be held manually, or fastening screws 96 located in slotted holes 98 may be tightened to hold the movable jaw 92 in a required location with respect to the fixed jaw 94 of the clamp 78 during the time required for the adhesive material to cure sufficiently. Once the adhesive material has been appropriately cured, each of the alignment eyes 90 may be removed by use of an appropriate tool, although each alignment eye preferably will be easily broken off as a result of chemical etching of a breakoff notch 100 part of the way through the termination portion 56 to which the alignment eye 90 is attached.

Once the process of laminating the signal conductor elements 36 and the separator elements 38 has been completed the tie tabs 74 may be removed by abrasives, for example, by using a faceting machine of the type used in shaping jewels. This leaves a flat surface on the back, or top, of the array 46 on which to mount the transverse shields 48.

It will be understood that, depending upon the thickness of each conductive element 36 or 44, it may be possible to manufacture these elements by die cutting them from a sheet of material or by cutting them to shape using computer-controlled laser cutting tools.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electrical connector for connection to multiple cable conductors comprising: multiple conductor elements, insulating separator elements separating the conductor elements from one another, body portions of the conductor elements and the separator elements being fabricated from sheets of material laminated together, an array of spaced apart spring contact portions projecting from the body portions of the conductor elements, and an array of spaced apart termination portions projecting from the body portions of the conductor elements for connection to respective multiple cable conductors, a transverse shield extending across margins on the conductor elements and margins on the separator elements, the transverse shield comprises, a sheet of conductive material between sheets of insulating material, and the insulating material facing toward said margins.

2. An electrical connector for connection to multiple cable conductors comprising: multiple conductor elements; insulating separator elements separating the conductor elements from one another; body portions of the conductor elements and the separator elements being fabricated from sheets of material laminated together; an array of spaced apart spring contact portions projecting from the body portions of the conductor elements; an array of spaced apart termination portions projecting from the body portions of the conductor elements for connection to respective multiple cable conductors; a transverse shield extending across margins on the conductor elements and margins on the separator elements; the transverse shield comprising; a sheet of conductive material between sheets of insulating material, the insulating material facing toward said margins, and multiple conductor elements and multiple insulating separator elements being on opposite sides of the transverse shield.

3. An electrical connector connected to multiple cable conductors comprising: multiple conductor elements constructed of lengthwise transmission line body portions, insulating separator elements separating the body portions from one other, the conductor elements and the separator elements being fabricated from sheets of material laminated together to form a laminated body, the lengthwise transmission line body portions each having lengthwise upper margins and lengthwise lower margins extending to ends of the body portions, termination portions projecting from respective ends of the body portions connected to respective conductors of multiple cable conductors, and spring contact portions projecting forwardly from respective ends of the body portions.

4. An electrical connector as recited in claim 3 wherein, a conducting shield extends transversely across the lower margins, insulating material extends between the conducting shield and the body portions of the conductor elements, contact surfaces on the spring contact portions project beyond a plane defined transverely by the lower margins of the body portions, and the spring contact portions are flexible in respective planes of the conductor elements.

5. An electrical connector as recited in claim 3, wherein, a conducting shield extends transversely across the sheets of material that are laminated together to form the laminated body, and insulating material extends between the conducting shield and the body portions of the conductor elements.

6. An electrical connector as recited in claim 3, and further comprising: a conducting first shield extends transversely across the lower margins, insulating material extends between the first shield and the body portions of the conductor elements, a conducting second shield extends transversely across the lower margins, and insulating material extends between the second shield and the body portions of the conductor elements.

7. An electrical connector as recited in claim 3 wherein, contact surfaces on the spring contact portions project beyond a plane defined transversely by the lower margins of the body portions, and the spring contact portions are flexible in respective planes of the conductor elements.

8. An electrical connector as recited in claim 3 wherein, each of the insulating separator elements comprises, a planar shield conductor between planar dividers of dielectric material.

9. An electrical connector comprising: a pair of laminated bodies separated by a conducting transverse shield, and insulating material between the transverse shield and each of the laminated bodies, each of the laminated bodies comprising: multiple conductor elements, multiple insulating separator elements separating the conductor elements from one other, body portions of the conductor elements and the separator elements being laminated together, an array of spaced apart spring contact portions projecting from the body portions, and an array of spaced apart termination portions projecting from the body portions for connection to respective multiple cable conductors, the transverse shield and the insulating material extending transversely of the body portions.

10. An electrical connector as recited in claim 9 wherein, on each of the laminated bodies the spring contact portions project beyond a plane defined transversely by lower margins of the body portions, and the spring contact portions are flexible in the respective planes of the conductor elements.

11. An electrical connector as recited in claim 9 wherein, the transverse shield extends transversely across said sheets of material.

12. An electrical connector as recited in claim 9, and further comprising: conducting second and third transverse shields extending across respective laminated bodies, the second and third transverse shields extending transversely across respective laminated bodies, and insulating material extending between the laminated bodies and each of the second and third shields.

13. An electrical connector as recited in claim 9 wherein, each of the insulating separator elements comprises, a planar shield conductor between planar dividers of dielectric material.

14. An electrical connector for connection to multiple cable conductors comprising: multiple conductor elements constructed of lengthwise transmission line body portions, insulating separator elements separating the body portions from one other, the conductor elements and the separator elements being fabricated from sheets of material laminated together to form a laminated body, the lengthwise transmission line body portions each having lengthwise upper margins and lengthwise lower margins extending to ends of the body portions, termination portions projecting from respective ends of the body portions for connection to respective conductors of multiple cable conductors, spring contact portions projecting forwardly from respective ends of the body portions, a conducting shield extending transversely across the lower margins, insulating material extending between the conducting shield and the body portions of the conductor elements, contact surfaces on the spring contact portions projecting beyond a plane defined transversely by the lower margins of the body portions, and the spring contact portions being flexible in respective planes of the conductor elements.

15. An electrical connector for connection to multiple cable conductors comprising: multiple conductor elements constructed of lengthwise transmission line body portions, insulating separator elements separating the body portions from one other, the conductor elements and the separator elements being fabricated from sheets of material laminated together to form a laminated body, the lengthwise transmission line body portions each having lengthwise upper margins and lengthwise lower margins extending to ends of the body portions, termination portions projecting from respective ends of the body portions for connection to respective conductors of multiple cable conductors, spring contact portions projecting forwardly from respective ends of the body portions, a conducting shield extending transversely across the sheets of material that are laminated together to form the laminated body, and insulating material extending between the conducting shield and the body portions of the conductor elements.

16. An electrical connector for connection to multiple cable conductors comprising: multiple conductor elements constructed of lengthwise transmission line body portions, insulating separator elements separating the body portions from one other, the conductor elements and the separator elements being fabricated from sheets of material laminated together to form a laminated body, the lengthwise transmission line body portions each having lengthwise upper margins and lengthwise lower margins extending to ends of the body portions, termination portions projecting from respective ends of the body portions for connection to respective conductors of multiple cable conductors, spring contact portions projecting forwardly from respective ends of the body portions, a conducting first shield extending transversely across the lower margins, insulating material extending between the first shield and the body portions of the conductor elements, a conducting second shield extending transversely across the upper margins, and insulating material extending between the second shield and the body portions of the conductor elements.

17. An electrical connector comprising: a pair of laminated bodies separated by a conducting transverse shield, and insulating material between the transverse shield and each of the laminated bodies, each of the laminated bodies comprising: multiple conductor elements, multiple insulating separator elements separating the conductor elements from one other, body portions of the conductor elements and the separator elements being fabricated from sheets of material laminated together, an array of spaced apart spring contact portions projecting from the body portions, and an array of spaced apart termination portions projecting from the body portions for connection to respective multiple cable conductors, the transverse shield extending transversely across said sheets of material.

18. An electrical connector comprising: a pair of laminated bodies separated by a conducting transverse shield, and insulating material between the transverse shield and each of the laminated bodies, each of the laminated bodies comprising: multiple conductor elements, multiple insulating separator elements separating the conductor elements from one other, body portions of the conductor elements and the separator elements being fabricated from sheets of material laminated together, an array of spaced apart spring contact portions projecting from the body portions, and an array of spaced apart termination portions projecting from the body portions for connection to respective multiple cable conductors, and further comprising: conducting second and third transverse shields extending across respective ones of the laminated bodies, the second and third transverse shields extending transversely across respective ones of the sheets of material of the respective laminated bodies, and insulating material extending between the laminated bodies and each of the second and third shields.

* * * * *